US009147369B2

(12) United States Patent
Yu et al.

(10) Patent No.: US 9,147,369 B2
(45) Date of Patent: Sep. 29, 2015

(54) DRIVING METHOD AND DRIVING CIRCUIT OF LIQUID CRYSTAL PANEL

(75) Inventors: Yao Yu, Beijing (CN); Jian Ren, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 544 days.

(21) Appl. No.: 13/283,227

(22) Filed: Oct. 27, 2011

(65) Prior Publication Data

US 2012/0105414 A1 May 3, 2012

(30) Foreign Application Priority Data

Oct. 28, 2010 (CN) ..... 2010 1 0529709

(51) Int. Cl.
*G09G 5/00* (2006.01)
*G09G 3/36* (2006.01)

(52) U.S. Cl.
CPC ..... *G09G 3/3674* (2013.01); *G09G 3/3685* (2013.01); *G09G 2310/0251* (2013.01); *G09G 2320/0233* (2013.01)

(58) Field of Classification Search
CPC ..... G09G 3/32; G09G 5/00; H04N 13/04; H06F 3/038
USPC ..... 345/211, 92, 212, 76, 82
See application file for complete search history.

(56) References Cited

U.S. PATENT DOCUMENTS

| | | | | |
|---|---|---|---|---|
| 5,561,441 | A * | 10/1996 | Hamano | 345/91 |
| 2004/0150605 | A1* | 8/2004 | Arimoto et al. | 345/100 |
| 2008/0143659 | A1* | 6/2008 | Ma | 345/87 |
| 2008/0252573 | A1* | 10/2008 | Fish et al. | 345/80 |
| 2009/0244049 | A1 | 10/2009 | Yamamoto et al. | |

FOREIGN PATENT DOCUMENTS

CN 101551974 A 10/2009

OTHER PUBLICATIONS

Chinese Intellectual Propery Office Notification of Reexamination dated May 27, 2014; Appln. 201010529709.2.

* cited by examiner

*Primary Examiner* — Pegman Karimi
(74) *Attorney, Agent, or Firm* — Ladas & Parry LLP

(57) ABSTRACT

The present invention discloses a driving method and a driving circuit of a liquid crystal panel, which relates to the field of liquid crystal displaying technology, and solves the problem of the ion accumulation in a TFT channel. The driving method of a liquid crystal panel according to embodiments of the present invention comprises: inputting an offset pinch-off voltage to gate scan lines of each row within a vertical blanking period between two successive frames, the offset pinch-off voltage being an original pinch-off voltage plus a predetermined voltage offset; and inputting the original pinch-off voltage to the gate scan lines at the time other than a gate turn-on time and the vertical blanking period. The embodiments of the present invention are mainly applied to the field of displaying of liquid crystal panels.

3 Claims, 3 Drawing Sheets

DRIVING METHOD AND DRIVING CIRCUIT OF LIQUID CRYSTAL PANEL

FIELD OF THE INVENTION

The present invention relates to the field of liquid crystal display technology, especially to a driving method and a driving circuit of a liquid crystal panel.

BACKGROUND OF THE INVENTION

A liquid crystal panel includes a TFT (Thin Film Transistor) array substrate and a color film substrate therein, and there are liquid crystals dripped between the color film substrate and the TFT array substrate. In order to enable the liquid crystal panel to display, a driving voltage is required to be input to the TFT array substrate by a driving circuit, in which a gate turn-on voltage is needed to be input onto a gate scan line on the TFT array substrate and a data voltage is needed to be input onto a data scan line thereon.

As an example, the present invention uses a signal OE2 as a second-order gate turn-on voltage control signal to explain the current implementation. The driving circuit of the liquid crystal panel includes mainly a timing controller, a power supply unit, a gate driving IC (Integrated Circuit) and a source driving IC. The timing chart of the driving voltage output by the driving circuit is as shown in FIG. 1, in which it is carried on from the left to the right in time order. Wherein, a rising edge of STV is a signal for the start of each frame, the signal OE2 controls a second-order gate turn-on voltage (VON), CPV is a gate shift signal. When a rising edge of STV comes so as to start scanning of one frame, a rising edge of CPV comes so as to control the start of scanning of one row each time when one falling edge of the signal OE2 comes. There is one horizontal blanking period between the horizontal display time of the current row and the horizontal display time of the next row, and the horizontal display time for each row plus the horizontal blanking period is one horizontal cycle. After completion of the scanning of the current row, the next rising edge of the signal OE2 comes when the current row just enters the horizontal blanking period, and the gate voltage is reduced. Further, the next rising edge of CPV comes, when the next falling edge of the signal OE2 comes, so as to control the start of scanning of the next row. In FIG. 1, $G_n$ and $G_{n+1}$ indicate the changes of levels of gate scan lines of the n-th row and the (n+1)-th row, respectively, in which Th is a vertical cycle.

As shown in FIG. 1, there is a vertical planking period, i.e. a blanking time, between two successive frames, that is, a vertical display time (Thd) subtracted from a vertical cycle (Th). Within the vertical blanking period, the voltages of gate scan lines of each row keep at −8V (a pinch-off voltage VOFF). In the present invention, the description is made taking the original pinch-off voltage of a TFT of −8V as an example, and the scanning of the next frame is not started until STV reaches a rising edge again.

In the course of driving a liquid crystal panel using the above driving manner, it is found that there is at least the following problem in existing techniques.

In the course that the data voltage input on a data scan line is input to a pixel electrode through a TFT, if the data voltage has certain regularity, for example, data voltages input continuously for a relatively long time are all at high levels, polarities of ions passing through a TFT channel will be fixed. When there are matters such as impurities in the TFT channel, they will attract or exclude these ions, resulting in that accumulation of ions occurs in the TFT channel (i.e. an active layer of the TFT). Accordingly, the accumulated ions will form an electric field around, leading to the interference to the electric field between the pixel electrode and a common electrode on the color film substrate and influencing finally on the display effect of the liquid crystal panel.

SUMMARY OF THE INVENTION

Embodiments of the present invention provide a driving method and a driving circuit of a liquid crystal panel capable of mitigating accumulation of ions in a TFT channel.

In order to achieve the above objects, the embodiments of the present invention employ technical solutions as follows.

A driving method of a liquid crystal panel, comprises:

inputting an offset pinch-off voltage to gate scan lines of each row within a vertical blanking period between two successive frames, the offset pinch-off voltage being an original pinch-off voltage plus a predetermined voltage offset; and inputting the original pinch-off voltage to the gate scan lines at the time other than a gate turn-on time and the vertical blanking period.

A driving circuit of a liquid crystal panel, comprises:

a power supply unit for outputting at least an offset pinch-off voltage and an original pinch-off voltage, the offset pinch-off voltage being the original pinch-off voltage plus a predetermined voltage offset; and a gate driving unit for inputting the offset pinch-off voltage to gate scan lines of each row within a vertical blanking period between two successive frames and for inputting the original pinch-off voltage to the gate scan lines at the time other than a gate turn-on time and the vertical blanking period.

The driving method and the driving circuit provided by the embodiments of the present invention switches the original pinch-off voltage to the offset pinch-off voltage at the time when the vertical blanking period comes so as to increase the current of a drain. The flow of more electrons may neutralize positive ions accumulated in a TFT channel, thus achieving the object of eliminating the positive ions in the TFT channel by the largest extent. In this way, the positive ions in the TFT channel form a weaker electric field around than that in the prior art, thereby the interference to the electric field between the pixel electrode and the common electrode on the color film substrate is less so that the influence on the display effect of the liquid crystal panel is weakened.

BRIEF DESCRIPTION OF THE DRAWINGS

In order to illustrate embodiments of the present invention or technical solutions in the prior art more clearly, a brief introduction will be made to attached drawings needed to in the description of the embodiments or the prior art in the following. Obviously, the attached drawings in the following description are only some embodiments of the present invention, and to those of ordinary skill in the art, other attached drawings may be obtained according to these attached drawings without inventive efforts.

DESCRIPTION OF THE PREFERRED EMBODIMENTS

In the following, the technical solutions in the embodiments of the present invention will be described clearly and thoroughly in combination with the attached drawings in the embodiments of the present invention. Obviously, the described embodiments are only a part of embodiments of the present invention and are not all of the embodiments. Based on the embodiments of the present invention, all of other embodiments obtained by those of ordinary skill in the art without inventive efforts belong to the protection scope of the present invention.

The embodiments of the present invention provide a driving method of a liquid crystal panel. The driving method inputs an offset pinch-off voltage to gate scan lines of each row within a vertical blanking period between two successive frames, the offset pinch-off voltage being an original pinch-off voltage plus a predetermined voltage offset; and inputs the original pinch-off voltage to the gate scan lines at the time other than a gate turn-on time and the vertical blanking period.

The embodiments of the present invention also provide a driving circuit of a liquid crystal panel including a power supply unit and a gate driving unit.

Wherein, the power supply unit, which may be a power supply chip, is used for outputting at least an offset pinch-off voltage and an original pinch-off voltage, the offset pinch-off voltage being the original pinch-off voltage plus a predetermined voltage offset; the power supply unit may also provide necessary power supply voltages to a data driving unit (a data driving IC), an electrode driving circuit and so on. The gate driving unit is used for inputting the offset pinch-off voltage to gate scan lines of each row within a vertical blanking period between two successive frames; the gate driving unit is also used for inputting the original pinch-off voltage to the gate scan lines at the time other than a gate turn-on time and the vertical blanking period.

The driving method and the driving circuit provided by the embodiments of the present invention switches the original pinch-off voltage to the offset pinch-off voltage at the time when the vertical blanking period comes so as to increase the current of a drain. The flow of more electrons may neutralize positive ions accumulated in a TFT channel, thus achieving the object of eliminating the positive ions in the TFT channel by the largest extent. In this way, the positive ions in the TFT channel form a weaker electric field around than that in the prior art, thereby the interference to the electric field between the pixel electrode and the common electrode on the color film substrate is less so that the influence on the display effect of the liquid crystal panel is weakened.

Embodiment 1

Figure 1:
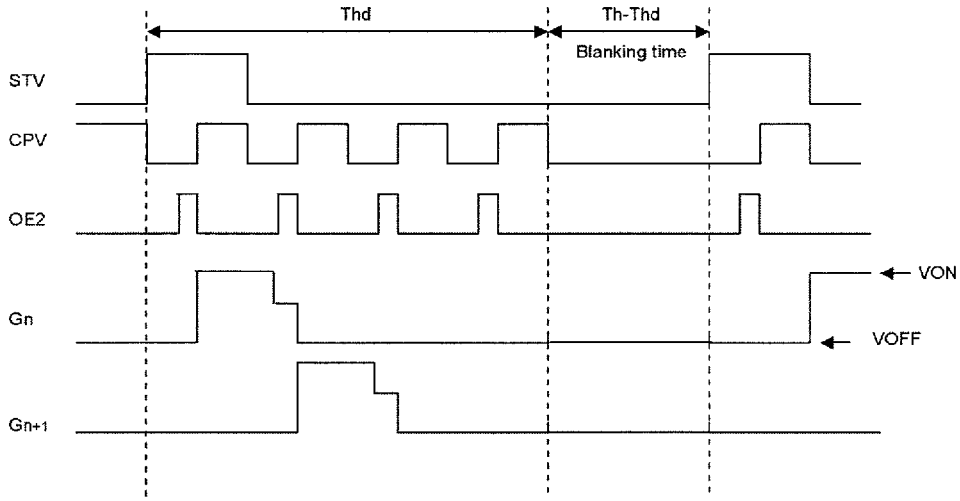
FIG. 1 is a timing chart of received and output signals of an original driving circuit in the prior art.
Figure 2:
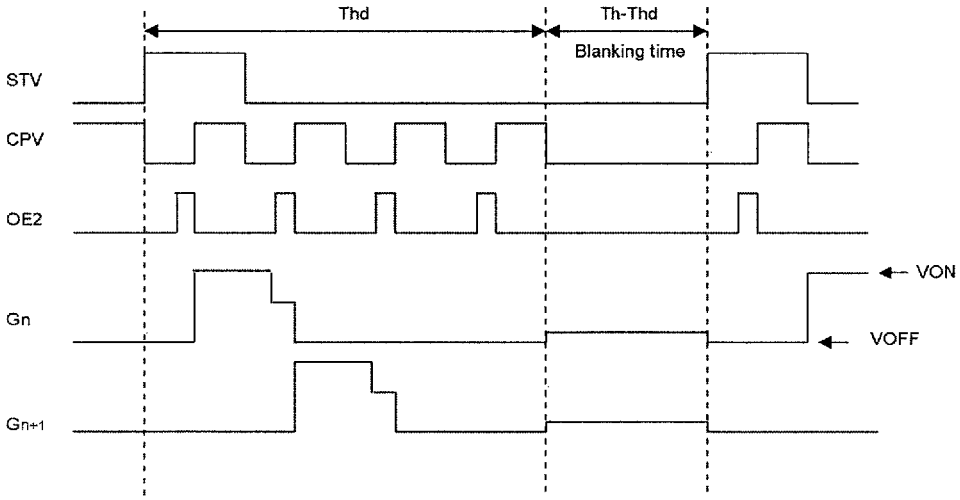
FIG. 2 is a timing chart of received and output signals of a driving circuit in embodiment 1 of the present invention.

The embodiment of the present invention provides a driving method of a liquid crystal panel as shown in FIG. 2, in which it is carried on from the left to the right in time order. Wherein, each frame starts when a rising edge of STV comes, the signal OE2 controls a second-order gate turn-on voltage (in the embodiment of the present invention, the description is made taking the signal OE2 as the control signal for the second-order gate turn-on voltage as an example), CPV is a gate shift signal. When a rising edge of STV comes so as to start the scanning of one frame, CPV becomes a high level, that is, a rising edge comes, so as to control the start of one row each time when one falling edge of the signal OE2 comes. The next rising edge of the signal OE2 comes when the row just enters the horizontal blanking period, and the gate voltage is reduced. Further, the next rising edge of CPV comes, when the next falling edge of the signal OE2 comes, so as to control the start of the next row. $G_n$, and $G_{n+1}$ indicate the changes of gate levels of the n-th row and the (n+1)-th row, respectively.

Figure 3:
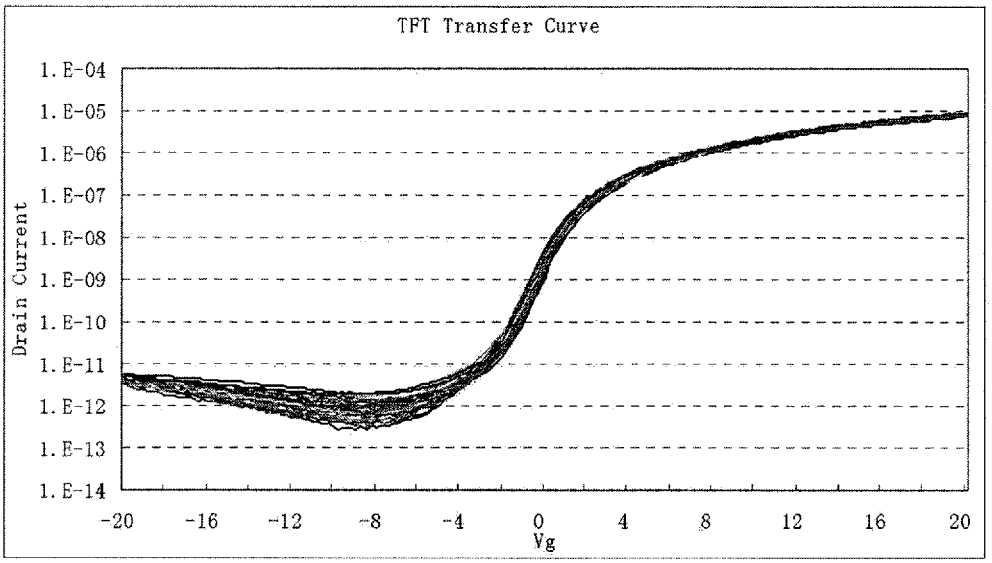
FIG. 3 is a graph of characteristics of a TFT in all embodiments of the present invention.
Figure 4:
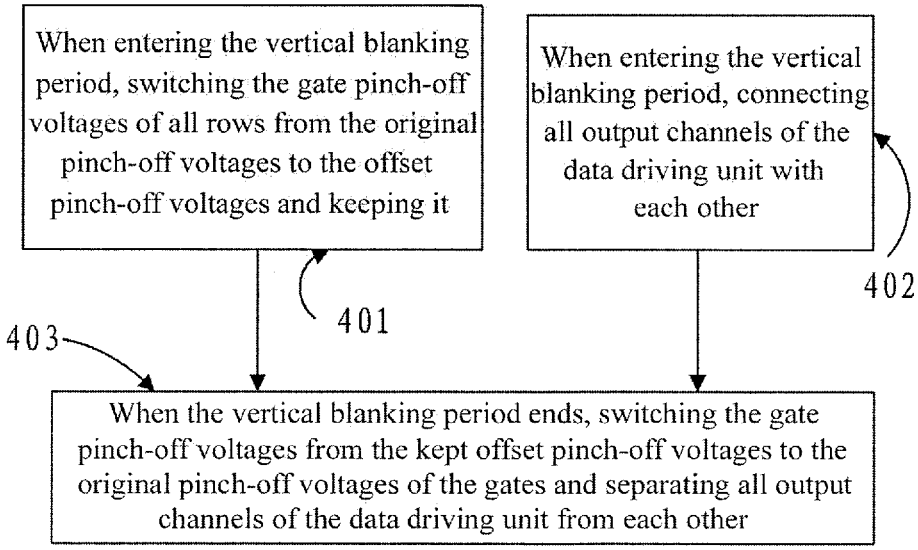
FIG. 4 is a flow chart of the driving circuit of the liquid crystal panel in embodiment 1 of the present invention.

In the power supply unit, two voltages, that is, an original pinch-off voltage and an offset pinch-off voltage, are configured for the gate pinch-off voltage. The drain voltage corresponding to the offset pinch-off voltage is five to twenty times of the drain voltage corresponding to the original pinch-off voltage. For example, for a TFT with the original pinch-off voltage being −8V, the offset pinch-off voltage may be made to be −6V to −5V, that is, a predetermined voltage offset is 2 to 3V. In the graph of characteristics of a TFT as shown in FIG. 3, when the gate pinch-off voltage is −8V, the drain current is approximately between 1E−13 A to 1E−12 A; when the gate pinch-off voltage is larger than −8V, the drain current increase as the gate pinch-off voltage increases within a certain range (below 20V); and when the gate voltage is less than −8V, the drain current change region is an overturn region which is not considered temporarily in the present invention. The embodiment of the present invention includes the flows as follows.

At 401, when entering the vertical blanking period, the gate pinch-off voltages of all of rows are switched from the original pinch-off voltages of −8V to the offset pinch-off voltages. For example, it is possible to switch to a numerical value between −6V and −5V. The embodiment of the present invention takes −5.5V (when the offset pinch-off voltage is −5.5V, the multiple of the drain current with respect to the drain current corresponding to the original pinch-off voltage is between 5 and 20) as an example to describe and keeps at it.

Wherein, −6V (the multiple of the drain current with respect to the drain current corresponding to the original pinch-off voltage is less than 5) is a lower limit, and if the offset pinch-off voltage is less than −6V, it can be seen as shown in FIG. 3 that the drain current at this time is not large enough and the effect of eliminating ions accumulated in a TFT channel by the largest extent cannot be not achieved; and −5V (the multiple of the drain current with respect to the drain current corresponding to the original pinch-off voltage is larger than 20) is a upper limit, and if the offset pinch-off voltage is larger than −5V, during the pinch-off period, it can be seen as shown in FIG. 3 that the drain current at this time is excessively large and a pixel capacitance and a storage capacitance will generate an electrical leakage due to the current being excessively large as the usage time of the display increases, thus a mura phenomenon occurs.

At 402, when entering the vertical blanking period, all output channels of a data driving unit are connected with each other. In the embodiment of the present invention, when entering the vertical blanking period, since the TFT adopts the row reversion or the point overturn, the data polarities of adjacent columns are opposite with each other. All output channels of the data driving unit are connected with each other to neutralize charges in all output channels of the data driving unit so as to realize that all TFT channels are performed in identical processes, so that the case where data voltages of respective columns are not identical with each other will not occur, thus it will not result in that the effects of eliminating ions accumulated in TFT channels within respective data columns by the largest extent are not consistent. Wherein, during the vertical blanking period, the output from data sources are all invalid data which are not received and displayed.

At 403, when the vertical blanking period ends, that is, when the next rising edge of STV comes, the gate pinch-off voltage is switched from −5.5V kept in the process e 401 to the original pinch-off voltage of the gate of −8V, and all output channels of the data driving unit are separated from each other.

Wherein, the process 401 switches the gate pinch-off voltages of all rows to −5.5V during the vertical blanking period in order for increasing the drain current, thus achieving the object of eliminating ions accumulated in a TFT channel by the largest extent; while during a normal driving period, it is required to be switched back to the original gate pinch-off voltage of −8V, because the TFT channel of a row which is not selected by the gate line needs to be pinched off completely by the original gate pinch-off voltage of −8V during the normal driving, and if the TFT channel of the row which is not selected by the gate line is not pinched off completely by the gate pinch-off voltage, the row which is not selected will be affected by the data voltages of other rows selected by the gate lines the magnitudes of which fluctuate within a range. Wherein, respective data columns of each horizontal cycle are all loaded with respective data of rows which are selected by the gate lines, and if the TFT channels of other rows are not pinched off completely at this time, they will be affected by the data voltages of rows which are selected by the gate lines.

In the present embodiment the description is made by taking the original pinch-off voltage of −8V only as an example, and during an actual application, other original pinch-off voltages than −8V may be used depending on difference of various TFT characteristics, and thus the corresponding offset pinch-off voltage is required to be changed accordingly as well, and the implementation principle thereof is the same as that of the present invention and unnecessary details are not given here.

The driving method of the liquid crystal panel provided by the embodiment of the present invention switches the original pinch-off voltage of the gate to the offset pinch-off voltage at the time when the vertical blanking period comes so as to increase the current of the drain. The flow of more electrons may neutralize positive ions accumulated in the TFT channel, thus achieving the object of eliminating the positive ions in the TFT channel by the largest extent. In this way, the positive ions in the TFT channel form a weaker electric field around than that in the prior art, thereby the interference to the electric field between the pixel electrode and the common electrode on the color film substrate is less so that the influence on the display effect of the liquid crystal panel is weakened.

Embodiment 2

Figure 5:
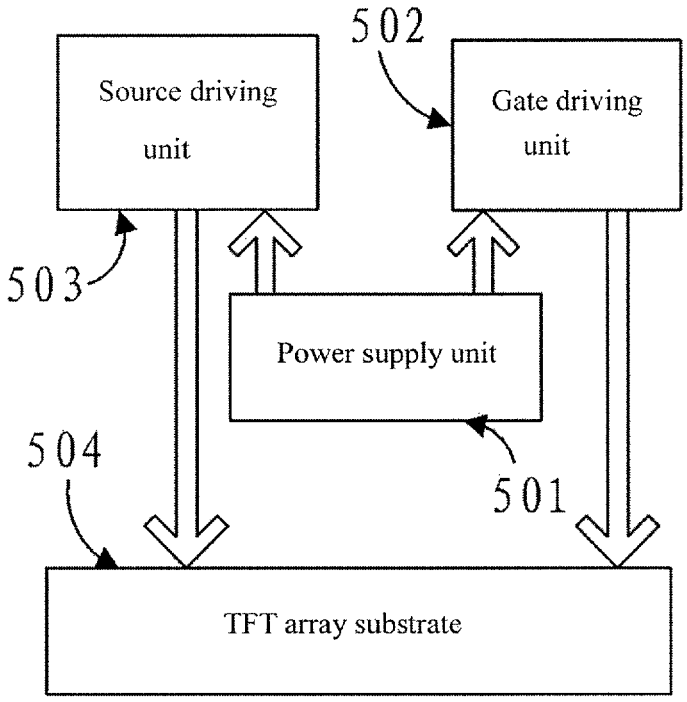
FIG. 5 is a block diagram of a driving circuit of a liquid crystal panel in embodiment 2 of the present invention.

The embodiment of the present invention provides a driving circuit of a liquid crystal panel, as shown in FIG. 5, including a power supply 501, a gate driving unit 502 and a source driving unit 503.

The driving circuit in the figure mainly provides the corresponding driving voltage for a TFT array substrate 504. The specific operation principle is as follows.

The power supply unit 501 may output voltages with different voltage values and outputs at least an offset pinch-off voltage and an original pinch-off voltage, and the drain current corresponding to the offset pinch-off voltage is five to twenty times of the drain voltage corresponding to the original pinch-off voltage. For example, for a TFT with the original pinch-off voltage being −8V, the offset pinch-off voltage may be made to be −6V to −5V, that is, the value of a predetermined voltage offset is taken between 2V and 3V. The offset pinch-off voltage of the embodiment of the present invention adopts −5.5V.

The gate driving unit 502 drives the TFT array substrate 504 in a certain timing. In the embodiment of the present invention, the gate driving unit 502 inputs the offset pinch-off voltage to gate scan lines of each row within the vertical blanking period between two successive frames. When entering the vertical blanking period, the gate driving unit 502 loads the offset pinch-off voltage onto the gates of TFTs of respective rows simultaneously. During the time other than the gate turn-on time and the vertical blanking period, the original pinch-off voltage is input to the gates of all TFTs of respective rows in a certain order. Wherein, the graph of characteristics of a TFT is as shown in FIG. 3. When the gate pinch-off voltage is −8V, the drain current is approximately between 1E−13 A to 1E−12 A; when the gate pinch-off voltage is larger than −8V, it can be seen that the drain current of the TFT increase as the gate pinch-off voltage increases within a certain range (below 20V); and when the gate voltage is less than −8V, the drain current change region is an overturn region which is not used temporarily in the present invention.

The source driving unit 503 is used for connecting all output channels output to the data scan line during the vertical blanking period with each other and for separating all output channels of the data driving unit from each other when the blanking period ends. Wherein, all of adjacent two output channels of the data driving unit may be connected with each other or be separated from each other and are controlled to be connected or separated by electronic switches. For example, if the electronic switch is closed, then two adjacent output channels at two terminals of the electronic switch are connected with each other; and if the electronic switch is opened, then two adjacent output channels at two terminals of the electronic switch are separated from each other. The opening and closing of all electronic switches are controlled by the source driving unit 503.

In the embodiment of the present invention, when entering the vertical blanking period, since the TFT adopts the row reversion or the point overturn, the data polarities of adjacent columns are opposite with each other. All output channels of the data scan lines are connected with each other to neutralize charges on all of the data scan lines so as to realize that all of TFT channels are performed in identical processes, so that the case where data voltages of respective columns are not identical with each other will not occur, thus it will not result in that the effects of eliminating ions accumulated in TFT channels within respective data columns by the largest extent are cont consistent. During the vertical blanking period, the output from data sources are all invalid data which are not received and displayed.

In the embodiment of the present invention, when the power supply unit 501 is designed, the design of a switch array for controlling charging and discharging of rapid capacitors inside is adjusted so that it outputs the original pinch-off voltage and the offset pinch-off voltage in a set cycle.

In the present embodiment the description is made by taking the original pinch-off voltage of −8V only as an example, and during an actual application, other original pinch-off voltages than −8V may be used depending on difference of various TFT characteristics, and thus the corresponding offset pinch-off voltage is required to be changed accordingly as well, and the implementation principle thereof is the same as that of the present invention and unnecessary details are not given here.

The driving circuit of a liquid crystal panel provided by the embodiment of the present invention switches the original pinch-off voltage of the gate to the offset pinch-off voltage at the time when the vertical blanking period comes so as to increase the current of the drain. The flow of more electrons may neutralize positive ions accumulated in a TFT channel, thus achieving the object of eliminating the positive ions in the TFT channel by the largest extent. In this way, the positive ions in the TFT channel form a weaker electric field around than that in the prior art, thereby the interference to the electric field between the pixel electrode and the common electrode on the color film substrate is less so that the influence on the display effect of the liquid crystal panel is weakened.

The present invention is mainly applied to the field of displaying of liquid crystal panels.

The described above is only specific embodiments of the present invention. Nevertheless, the protection scope of the present invention is not limited thereto and those skilled in the art may easily think of variations and replacements, which are all covered within the protection scope of the present invention, within the technical scope disclosed by the present invention. Therefore, the protection scope of the present invention should be defined by the claims.

What is claimed is:

1. A driving method of a liquid crystal panel, comprising:

inputting an offset pinch-off voltage simultaneously to each row of gate scan lines within a vertical blanking period between two successive frames and maintaining the offset pinch-off voltage until the vertical blanking period ends, the offset pinch-off voltage being an original pinch-off voltage plus a predetermined voltage offset; and inputting the original pinch-off voltage to the gate scan lines at the time other than a gate turn-on time and the vertical blanking period, wherein during the vertical blanking period, a gate of thin film transistor corresponding to each row of gate scan lines is in a pinch-off state; and a drain current corresponding to the offset pinch-off voltage is 5 to 20 times the drain current corresponding to the original pinch-off voltage.

2. The driving method of the liquid crystal panel according to claim 1, wherein all output channels of a data driving unit are connected with each other within the vertical blanking period.

3. The driving method of the liquid crystal panel according to claim 1, wherein the original pinch-off voltage is −8V.

* * * * *